United States Patent [19]

Smith

[11] Patent Number: 4,593,601

[45] Date of Patent: Jun. 10, 1986

[54] RECOIL SPRING SYSTEM FOR SELF LOADING FIRE ARMS

[76] Inventor: David E. Smith, 5 Park Avenue, Telscombe Cliffs, Sussex, England

[21] Appl. No.: 593,391

[22] Filed: Mar. 26, 1984

[30] Foreign Application Priority Data

Mar. 28, 1983 [GB] United Kingdom ..... 8308439

[51] Int. Cl.[4] ..... F41D 11/12

[52] U.S. Cl. ..... 89/199; 89/196

[58] Field of Search ..... 89/199, 196, 198, 163

[56] References Cited

U.S. PATENT DOCUMENTS

| | | | |
|---|---|---|---|
| 1,105,416 | 7/1914 | Fyrberg | 89/196 X |
| 1,143,472 | 6/1915 | Whiting | 89/196 |
| 1,276,716 | 8/1918 | Browning | 89/199 X |
| 1,277,379 | 9/1918 | Chadwick et al. | 89/199 X |
| 1,557,435 | 10/1925 | Diehm | 89/199 X |
| 2,135,992 | 11/1938 | Walther | 89/199 X |
| 2,248,445 | 7/1941 | Wilson | 89/199 |

FOREIGN PATENT DOCUMENTS

| | | | |
|---|---|---|---|
| 20367 | of 1911 | United Kingdom | 89/196 |

*Primary Examiner*—David H. Brown

*Attorney, Agent, or Firm*—Harness, Dickey & Pierce

[57] ABSTRACT

A recoil spring system for a self-loading pistol type fire arm having a reciprocating breech block slide comprises a pair of compression springs (P) located in respective tunnels (B1, B2) in the side walls of the slide (B), each said spring abutting at its front end against the front inner wall (B9) of the slide and at its rear end against a stop (A1, A2) on the frame (A), which stop on recoil of the slide passes through a slot (B7, B8) at the rear of the slide connecting the tunnel to an external surface of the slide. The springs can be kept safely in the slide even after disassembly thereof from the fire arm.

5 Claims, 11 Drawing Figures

RECOIL SPRING SYSTEM FOR SELF LOADING FIRE ARMS

This invention relates to self loading fire arms of the pistol type in which a reciprocating breech block slide is employed, and which is provided with spring means for imparting a constant regular spring pressure in a forward direction upon the slide, this pressure serving to regulate the recoil of the slide on discharge of a cartridge in the barrel of the fire arm, and returning the slide to the forward battery position, the slide performing all the usual functions related to a self loading fire arm on its forward motion.

The usual practice in self loading pistols is for them to employ a spring or springs to exert forward pressure upon a slide, the spring or springs being placed around a suitable guide rod, or rods, or in a suitable recess or recesses and being compressed around or in these on recoil of the slide. The usual practice in self loading pistols is that on disassembly of the pistol the recoil spring or springs become loose and detached from the other parts of the pistol.

The disadvantage of this practice in pistols is that upon disassembly, accommodation must be found for the spring or springs, and these are liable to be misplaced, damaged, or exposed to dirt.

Greater convenience is provided by certain pistols that retain the spring on the barrel, that being a guide, or retain the springs in tunnels or recesses and allow the user to remove them at the users discretion. These convenient systems are usually employed on low power pistols not using a locked breech system.

It is therefore an object of the invention to provide for self loading pistols or fire arms recoil springs securely accommodated in the slide, and kept in the slide in a manner permitting easy and quick removal by the user when required.

It is another object of the invention to simplify the manipulations involved in disassembling and assembling a self loading pistol or fire arm.

It is another object of the invention to provide a recoil spring system for a self loading pistol or fire arm that does not require tools to disassemble it.

It is another object of the invention to provide recoil springs that are retained in the pistol's slide at all times, and are only removable from the slide at the will of the user after the removal of the barrel from the pistol frame.

It is a further object of the invention to provide a recoil spring system for a self loading pistol or other fire arm that is of simple construction and cheap to manufacture.

According to the invention, there is provided a self loading fire arm of the pistol type, having a reciprocating breech block slide and spring means for exerting pressure in a forward direction on said slide to regulate the recoil of said slide on discharge of a cartridge in the barrel of said fire arm, said spring means comprising a pair of compression springs held in respective tunnels formed in the side walls of said slide and extending substantially the full length thereof, each said spring abutting at its forward end against the front wall of said slide and at its rear end against a respective stop on the frame of the fire arm, which on recoil of the slide passes through a slot at the rear of the slide connecting the tunnel to an exterior surface of the slide.

An embodiment of the invention is shown in the drawings and will be described in greater detail hereinafter. The same letters of reference indicate corresponding parts in the several FIGS. of the drawings.

FIG. 1 of the accompanying drawings represents, partly in elevation and partly in longitudinal vertical section, a self loading semi automatic pistol provided with means constructed and arranged in accordance with this invention for a spring system to furnish a reactive force to enable the slide and related parts to perform a correct firing, extraction, ejection, and cartridge feeding cycle, showing the pistol with the slide in the forward battery position, recoil spring system fitted;

Figures 1, 2, 3, 4, 5, 6, 7, 8:
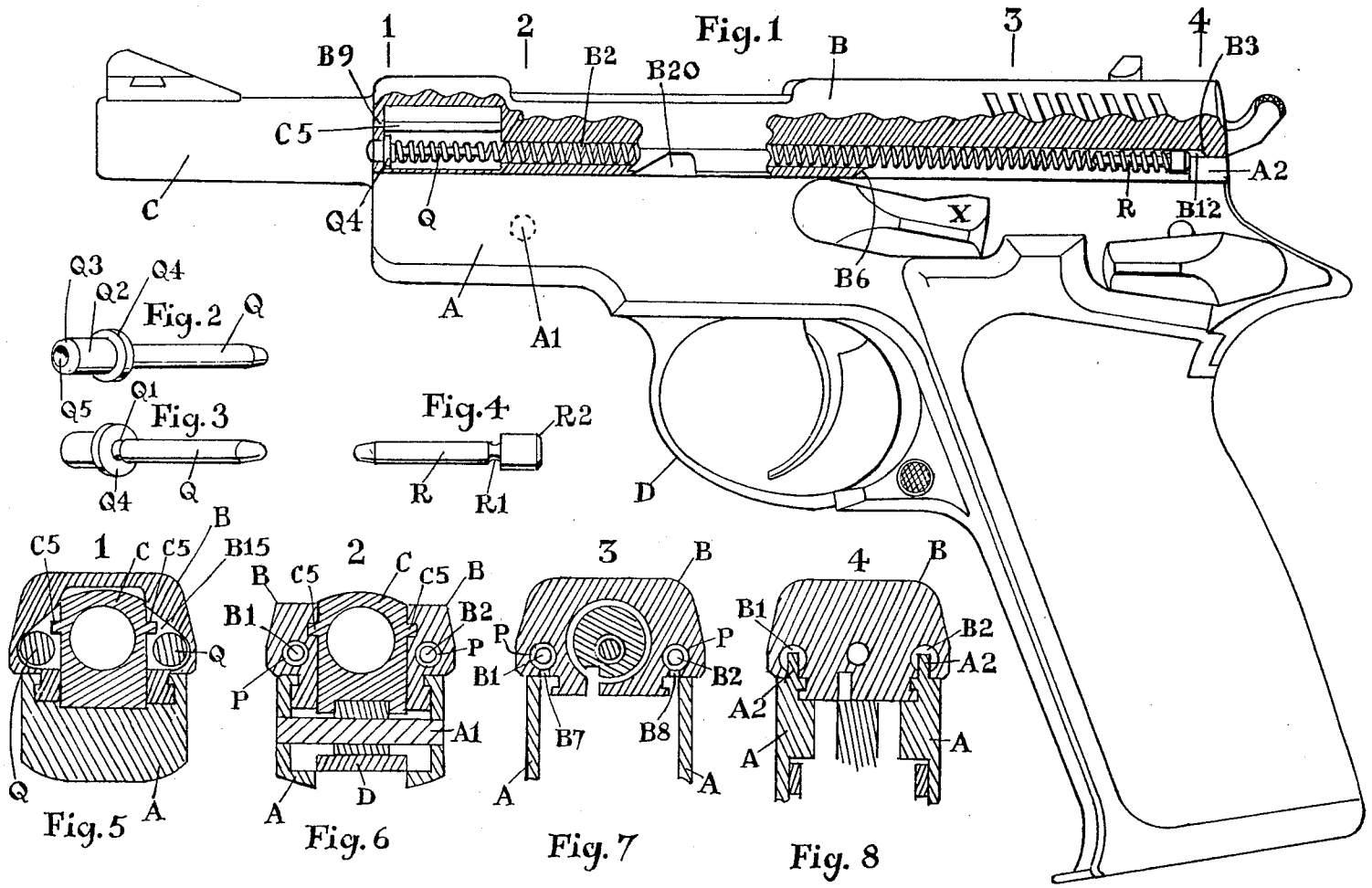
FIG. 2 is a perspective view of the front recoil spring guide and retainer, viewed from the left front.
FIG. 3 is a perspective view of the front recoil spring guide and retainer, viewed from the left rear.
FIG. 4 is an elevation view of the rear recoil spring guide.
FIG. 5 is a transverse vertical section of FIG. 1 upon line 1.
FIG. 6 is a transverse vertical section of FIG. 1 upon line 2.
FIG. 7 is a transverse vertical section of FIG. 1 upon line 3.
FIG. 8 is a transverse vertical section of FIG. 1 upon line 4.
Figure 9:
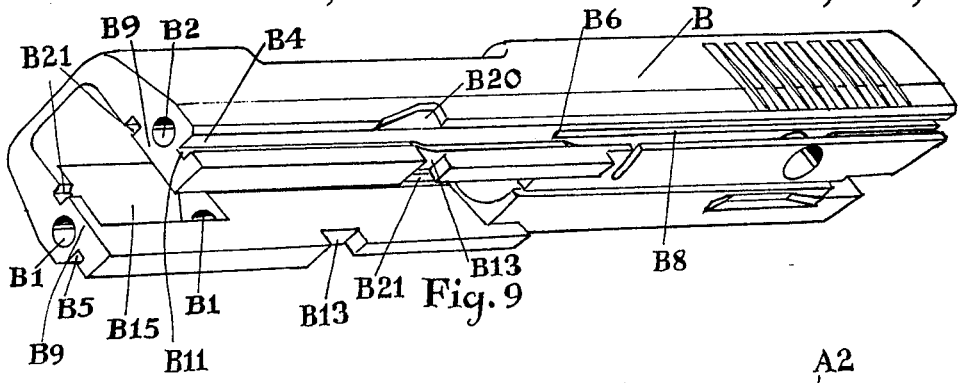
FIG. 9 is a perspective view of the slide, viewed from front lower left.
Figure 10:
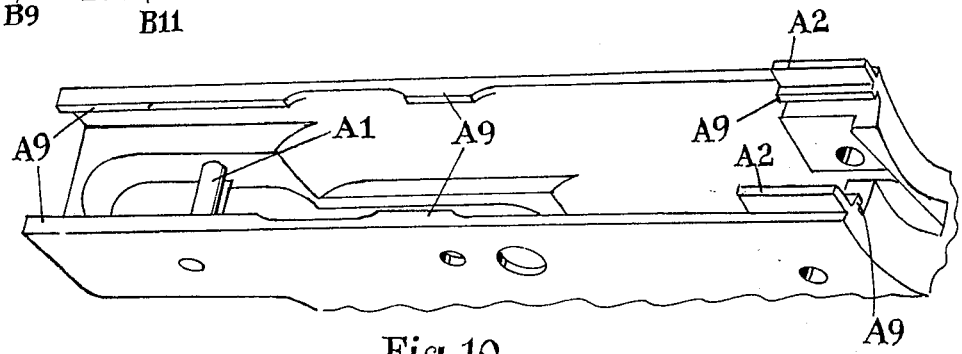
FIG. 10 is a perspective view of the frame, viewed from above and from the left.

In the self loading pistol represented in FIG. 1, the slide B has two longitudinal parallel circular tunnels B1 and B2 which pass clear from the front of the slide to the position B3. Flat longitudinally extending horizontal planes B4 and B5 run parallel beneath each tunnel and two longitudinally extending vertical slots B7 and B8 pass from the rear of the slide, each slot passing along the axis of a tunnel and opening at a respective one of the planes B4 and B5, the slots extending lengthwise of the rear portion of each tunnel and terminating at the position B6 as shown in FIG. 1 and FIG. 9. The recoil spring P has at each end a coil of reduced diameter. Each spring holds at one end a recoil spring front guide Q and at the opposite end a recoil spring rear guide R. Each guide has an annular groove, R1 and Q1, into which the reduced end coils of the recoil spring securely fit. The complete spring unit of spring, front guide and rear guide is inserted into its respective tunnel, feeding the end R2 of the rear guide into cavity B15 inside each slide front wing and thus into the continuation of holes B1 and B2 at the rear of each cavity. The rear spring guides are pushed rearwards in each spring tunnel B1 and B2 until each front spring guide enters the respective cavity, when the front Q2 of each front spring guide can be pushed into the cavity. When pushed into the cavity spring pressure will force each front spring guide forwards against the rear of wall B9 and the forward section Q3 of each spring guide can enter the rear of hole B1 and B2 in each wall B9. The flange Q4 on each front spring guide will prevent the spring guides from passing through the hole B1 or hole B2 in each wall B9. With the rear guides forced rearwards by recoil spring pressure against the termination of each spring tunnel at point B3 in the slide the recoil spring units will be securely retained in their respective tunnels and thus in the slide.

The slide is mounted onto the frame A from the front, the frame guide ribs A9 engaging in the slide grooves B11. The slide is retracted to the rear, and the rear recoil spring guides will impinge upon the frame wings A2, thereby starting to compress the recoil springs before the slide is in the front battery position as shown in FIG. 1 as shown in FIG. 1 the frame wings A2 comprise stops which, when the slide is in its forward battery position illustrated, are received in the slot portions which extend through the rear wall of the slide. The space B12 shown in FIG. 1 represents the amount of compression the recoil springs are subjected to when the slide is in the battery position. In the pistol represented, the slide is prevented from moving forward off the frame by the barrel C being held by a locking block seating against frame pin A1. The locking block having a wing passing transversely through a recess under the barrel and engaging in recesses B13 of the slide. When the slide is retracted fully the hold open catch X can be engaged in slide cut out B20 and the trigger guard D is depressed, pivoting the locking block around pin A1, and disengaging the locking block wing from the barrel allowing the barrel to be removed forward, the barrel ribs C5 running in slide longitudinal grooves B21. After barrel removal the hold open catch can be disengaged from the slide cut out and the slide can be removed forwards off the frame guide ribs.

It is possible that a number of means could be used to secure the barrel and slide to the frame, but this would not affect the application of this invention.

Figure 11:
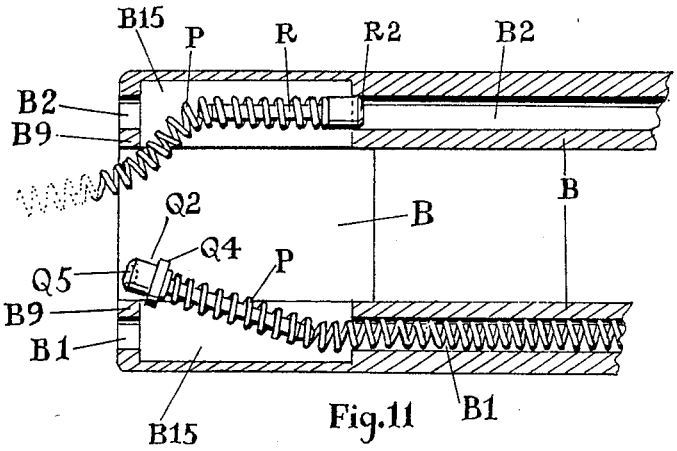
FIG. 11 is a longitudinal transverse section of the front slide along the axes of the recoil spring tunnels, showing removal or insertion of front and rear recoil spring guides with attached recoil springs.

The concave circular cavity Q5 in the front of the front spring guide is intended to help disassembly of the recoil spring units from the slide. An object such as the point of a ball point pen, the pointed end of a nail, the pointed bullet end of a rifle cartridge, or any other suitable shaped object, can be placed in the cavity Q5 and pressure exerted against the tension of the respective spring. When the forward section Q3 of the respective spring guide is clear of hole B1 or B2 in walls B9 the front of Q2 of the spring guide can be pivoted inwards to clear the inward edge of the wall B9. The inherent flexibility of the recoil spring will allow the pivoting of the front recoil spring guide and the removal of the whole recoil spring unit from the tunnel B1 or B2, whichever, the recoil spring flexing inwards in cavity B15 and passing through an inwardly directed longitudinally extending aperature communicating with the cavity B15 at the forward end of the tunnel B1 or B2 as it is withdrawn, as it would when being inserted, and there would be ample clearance to allow the rear recoil spring guide to clear the tunnel, and with the recoil spring attached, also with the spring flexed at the front R3 of the rear guide, the rear guide can be removed inwards from cavity B15, as in FIG. 11.

The application of the invention to other small arms differs in no essential respect from its application to pistols of the type hereinbefore described.

The terms "horizontal" and "vertical" as used herein refer to the pistol or other fire arm when held in the normal firing position.

I claim:

1. In a self loading fire arm of the pistol type comprising:

a frame;

a barrel removably mounted to said frame;

a removable breech block slide mounted for reciprocating movement on said frame between a forward battery position and a rearward retracted position, the frame and slide including guide means extending longitudinally thereof for guiding said reciprocating movement and said slide having front and rear end walls and side walls in which are provided respective spring receiving means extending lengthwise of the slide for substantially the full length thereof; and spring means for exerting pressure in a forward direction on said slide to regulate the recoil of the slide upon discharge of a cartridge in said barrel, said spring means comprising a pair of compression springs held under compression in respective ones of said spring receiving means with the forward end of the compression spring held in each spring receiving means being supported at the forward end of the spring receiving means, said frame comprising a pair of stops engaged by the rearward ends of said compression springs;

the improvement in that said spring receiving means each comprise a tunnel in said slide, each said spring receiving means being limited at its rear end by the rear wall of the slide; a slot extends lengthwise of the rear portion of each said tunnel and has a portion thereof extending through the rear wall of the slide, each said slot connecting the tunnel to the exterior of the slide, and the stops on said frame extend through said slots to engage the rear ends of said compression springs, the stops being positioned on said frame to be received in said slot portions in said rear wall of the slide when the slide is in its forward battery position.

2. A fire arm as claimed in claim 1, wherein both ends of each said spring are provided with respective guide members, each having a stem portion which penetrates into the end of the spring, an annular groove into which the end coil of the spring which is of reduced diameter is a spring fit, and a portion adapted to abut respectively against the front wall of said slide and said stop.

3. In a self loading fire arm of the pistol type comprising:

a frame;

a barrel removably mounted to said frame;

a removable breech block slide mounted for reciprocating movement on said frame between a forward battery position and a rearward retracted position, the frame and slide including guide means extending longitudinally thereof for guiding said reciprocating movement and said slide having front and rear end walls and side walls in which are provided respective spring receiving means extending lengthwise of the slide for substantially the full length thereof; and spring means for exerting pressure in a forward direction on said slide to regulate the recoil of the slide upon discharge of a cartridge in said barrel, said spring means comprising a pair of compression springs held under compression in respective ones of said spring receiving means with the forward end of the compression spring held in each spring receiving means supported at the forward end of the spring receiving means, said frame comprising a pair of stops engaged by the rearward ends of said compression springs;

the improvement in that said spring receiving means each comprise a tunnel in said slide, each said tunnel being limited at its rear end by the rear wall of the slide; a slot extends lengthwise of the rear portion of each said tunnel and has a portion thereof extending through the rear wall of the slide, each said slot connecting the tunnel to the exterior of the slide, and the stops on said frame extend through said slots to engage the rear ends of said compression springs, the stops being positioned on said frame to be received in said slot portions in said rear wall of the slide when the slide is in its forward battery position, and each said tunnel is provided with an inwardly directed longitudinally extending aperture at its forward end through which said spring can be introduced into or removed from said slide, after removal of the barrel and the slide from the fire arm.

4. A fire arm as claimed in claim 3, wherein both ends of each said spring are provided with respective guide members each having a stem portion which penetrates into the end of the spring, an annular groove into which the end coil of the spring which is of reduced diameter is a spring fit, and a portion adapted to abut respective against the front wall of the slide and said stop.

5. A fire arm as claimed in claim 4, wherein the abutting portion of said forward one of said guide members is provided with a flange part adapted to abut against the inner side of the front wall of said slide, and a nose portion projecting through an aperture in said front wall of the slide, whereby said spring can be disengaged from abutment against the front wall of the slide for removal by pressure exerted on the projecting end of said nose part.

* * * * *